US005428324A

United States Patent [19]

Andersson et al.

[11] Patent Number: 5,428,324

[45] Date of Patent: Jun. 27, 1995

[54] YIG MICROWAVE OSCILLATOR

[75] Inventors: Ronny Andersson, Tullinge; Gunnar Andersson, Norsborg, both of Sweden

[73] Assignee: Sivers Ima AB, Sweden

[21] Appl. No.: 98,209

[22] Filed: Jul. 28, 1993

[30] Foreign Application Priority Data

Oct. 2, 1992 [SE] Sweden ..... 9202871

[51] Int. Cl.[6] ..... H01P 1/218

[52] U.S. Cl. ..... 333/202; 333/219.2; 331/96

[58] Field of Search ..... 333/202, 219, 219.2, 333/235, 201, 148; 331/96, 104 DP, 117 D, 67, 68

[56] References Cited

U.S. PATENT DOCUMENTS

| | | | |
|---|---|---|---|
| 4,484,161 | 11/1984 | Barger | 333/202 |
| 4,605,911 | 8/1986 | Jin | 333/148 X |
| 4,651,116 | 3/1987 | Schloemann | 333/202 |
| 5,115,209 | 5/1992 | Grace et al. | 331/49 |

FOREIGN PATENT DOCUMENTS

| | | | |
|---|---|---|---|
| 0152804 | 6/1989 | Japan . | |
| 0280602 | 12/1991 | Japan | 333/219.2 |
| 2161653 | 1/1986 | United Kingdom | 333/202 |

*Primary Examiner*—Seungsook Ham

*Attorney, Agent, or Firm*—Christier, Parker & Hale

[57] ABSTRACT

The invention is directed to the structure of a YIG-component. The component comprises a magnetic circuit for generating an homogeneous magnetic field in an air gap of the magnetic circuit and at least one ferrite crystal (81) arranged in the air gap. The magnetic resonance frequency of the ferrite crystal (81) may be controlled dependent on the strength of the homogeneous magnetic field. The magnetic circuit is enclosed in a cavity of a housing (53, 55) arranged for mechanically relieving the magnetic circuit from external influence. The housing (53, 55) may be formed from a material selected at will. The magnetic circuit is arranged in a specifically shaped seat for accurate positioning of the air gap in the housing (53, 55). A foundation formed in the housing (53, 55) is provided for supporting a YIG-unit (75) comprising the ferrite crystal (81) with correct positioning of the ferrite crystal in the air gap.

4 Claims, 3 Drawing Sheets

YIG MICROWAVE OSCILLATOR

BACKGROUND OF THE INVENTION

This invention is directed to YIG-components in general and more specifically to a YIG-component comprising a magnetic circuit for generating an homogeneous magnetic field in an air gap of the magnetic circuit, and at least one ferrite crystal arranged in said air gap and having a magnetic resonance frequency which may be controlled dependent on the strength of said homogeneous magnetic field.

"YIG-components" is a generic term for devices using ferrite crystals, that is thin layers or crystals of YIG (yttrium-iron-garnet), LiF (lithium-ferrite) NiZnFe (nickel-zing-ferrite), etc., as resonators in for example electric oscillators, filters and discriminators. YIG-components are used in high frequency applications for frequencies from about 500 MHz and upwards. Electromagnetic frequencies in this range are often denoted microwaves and electric circuits operating at these frequencies are denoted "microwave circuits" herein.

In order to be able to provide a resonator using a ferrite crystal, a strong, homogeneous magnetic field is required in which the ferrite crystal is arranged. The magnetic field is generated by a magnetic circuit comprising an electromagnet or a permanent magnet in combination with a magnetic iron structure. The magnetic resonance frequency of the resonator is directly proportional to the strength of the magnetic field. It follows from this that when using an electromagnet, the resonance frequency of a YIG-component may be controlled electrically via the current through said electromagnet. The ferrite resonator has a number of good features and is characterized by a high Q-value and that it may be controlled electrically within very broad frequency ranges (several octaves).

The majority of prior art YIG-components have a design in which the electromagnet completely or partly constitutes the housing and carrier for the remaining components, such as said ferrite crystal, microwave circuits etc., required tomake up the intended YIG-component. Because magnetic iron is a material which is difficult to work the intention has been to provide an uncomplicated mechanical structure for the YIG-component. This has brought about a construction in which the magnetic core is constituted by a cylinder having a bottom, a cap and a central pin or pole pin, extending upwards from the bottom towards the cap and leaving a slot (pole gap) between the upper end of the pin and the cap. A coil is disposed around the pin. The remaining components are mainly arranged in the space defined between the magnetic coil and the cap of the magnetic core and are attached to the cap or the cylinder wall.

This prior art construction has several drawbacks. Above all it is relatively big, heavy and expensive because the magnetic material is a specific and expensive alloy which is difficult to work. The construction has been gradually minimized but size minimization is limited by the fact that the components which are accommodated therein require a fixed amount of space and by the fact that the resonator must be oriented to the center of the mechanic structure.

The thermal conductivity of magnetic iron is low and this is a disadvantage of the prior art construction because a relatively high power dissipation from said coil and circuits must be cooled via this material.

Certainly, the prior art YIG-components may be controlled electrically but high inductance in the control coil and troublesome eddy currents have the consequence that changes of frequency are relatively time consuming, thereby limiting the range of possible applications. Of the magnetic flux which is generated by the electromagnet, the greater part flows upwards through said pole pin via said slot or pole gap to said cap, downwards through said cylinder and bottom and returns upwards through the pole pin. The magnetic flux thus passes through many parts of different sections and circumferences. When making a current change in order to change the resonance frequency, a flux change results. In that case, eddy currents are induced at each section/circumference with a varying strength and decay time or time constant dependent on the section/-circumference. These eddy currents initiate an exponential delay between tuning current and magnetization (frequency change). This delay may be compensated by a "driver", an electronic curcuit for voltage-to-current transformation which is used for enabling the YIG-component voltage to be controlled. A magnet of this conventional design initiates about five different time constants, which must be compensated by an equal number of compensation networks, each of which must be defined in respect of proportionality and time constant in order to counteract said delay effectively.

The conventional magnet design generates a large leakage flux. The optimal situation is when the total magnetic flux passes through the pole gap or air gap between the pole pin and the cap, but in the prior art construction a significant part deflects away from the pole pin and passes outside the pole gap, generating excessive inductance.

Furthermore the conventional YIG-component is sensitive to mechanical influences as well as external magnetic fields from fans, motors, etc., which may modulate the resonance frequency. Accordingly, a specific mechanical mounting and an external, magnetic shield of $\mu$-metal arranged around the YIG-component, respectively, are often required.

The YIG-component is ordinarily used in a microwave system in which a number of electric functions are desirable, and in which the YIG-component is intended for cooperation with other YIG-components or other units. It follows from this that said components and units must be interconnected by means of external contacts, cables and mechanical devices.

Up to now, the range of application of the YIG-components has been limited by the abovementioned drawbacks.

SUMMARY OF THE INVENTION

An object of the invention is to eliminate the drawbacks of the prior art technology and to provide a YIG-component which is small, easy to assemble on a circuit board and allows for integration of a number of desirable functions.

It is a further object of the invention to provide a YIG-component which is substantially less sensitive to mechanical and magnetic influence in comparison with prior art components, which has substantially only one time constant, and which has a low inductance for obtaining rapid changes of frequency.

The objects of the invention are achieved in a YIG-component according to this invention, said component being characterized in that the magnetic circuit is enclosed within a cavity of a housing arranged for mechanically relieving the magnetic circuit from external influence and shaped from a material selected at will, the magnetic circuit is disposed on a specifically shaped seat for an accurate positioning of the air gap in said housing, and a foundation is defined in said housing for supporting a YIG-unit comprising said ferrite crystal, with correct positioning of the ferrite crystal in the air gap.

The YIG-component thus obtained according to the invention discloses a completely novel way of thinking. In a sense the old construction has been turned inside out. The magnetic core no longer constitutes the housing, but instead a specific housing has been formed enclosing the remaining component parts. This means that the construction may be made substantially smaller and allows greater freedom because the incorporated elements may be positioned fairly much at will in the housing and the magnetic circuit may be made smaller with less regard to the size of the remaining elements. Further, the housing may be of a different material than the specific alloy mentioned above may be shaped with high precision to a complicated structure, in order to ensure that elements requiring an accurate mutual alignment will be positioned correctly when arranged in the housing without time consuming readjustment.

A preferred embodiment of the invention is characterized in that the modulation coil comprises a printed circuit.

This embodiment has a number of advantages in comparison with prior art technology, because the magnetic circuit of the YIG-component according to the invention may be made small and a very short air gap may be formed. This allows only for a very thin modulation coil. When using a conventional, wire-wound modulation coil in this compact magnetic structure, it has to be positioned outside the air gap, this bringing inferior performance in respect of modulation features in comparison with a conventionally built YIG-component. According to this preferred embodiment of the invention, a modulation coil has been obtained which is adapted to the existing conditions of the YIG-component according to the invention and provides for substantially improved modulation features as compared with a conventional type modulation coil.

BRIEF DESCRIPTION OF THE DRAWINGS

The YIG-component according to the invention will be described in greater detail in the form of an exemplary embodiment and with reference to the drawings, in which.

DESCRIPTION OF THE PREFERRED EMBODIMENTS

Figure 1:
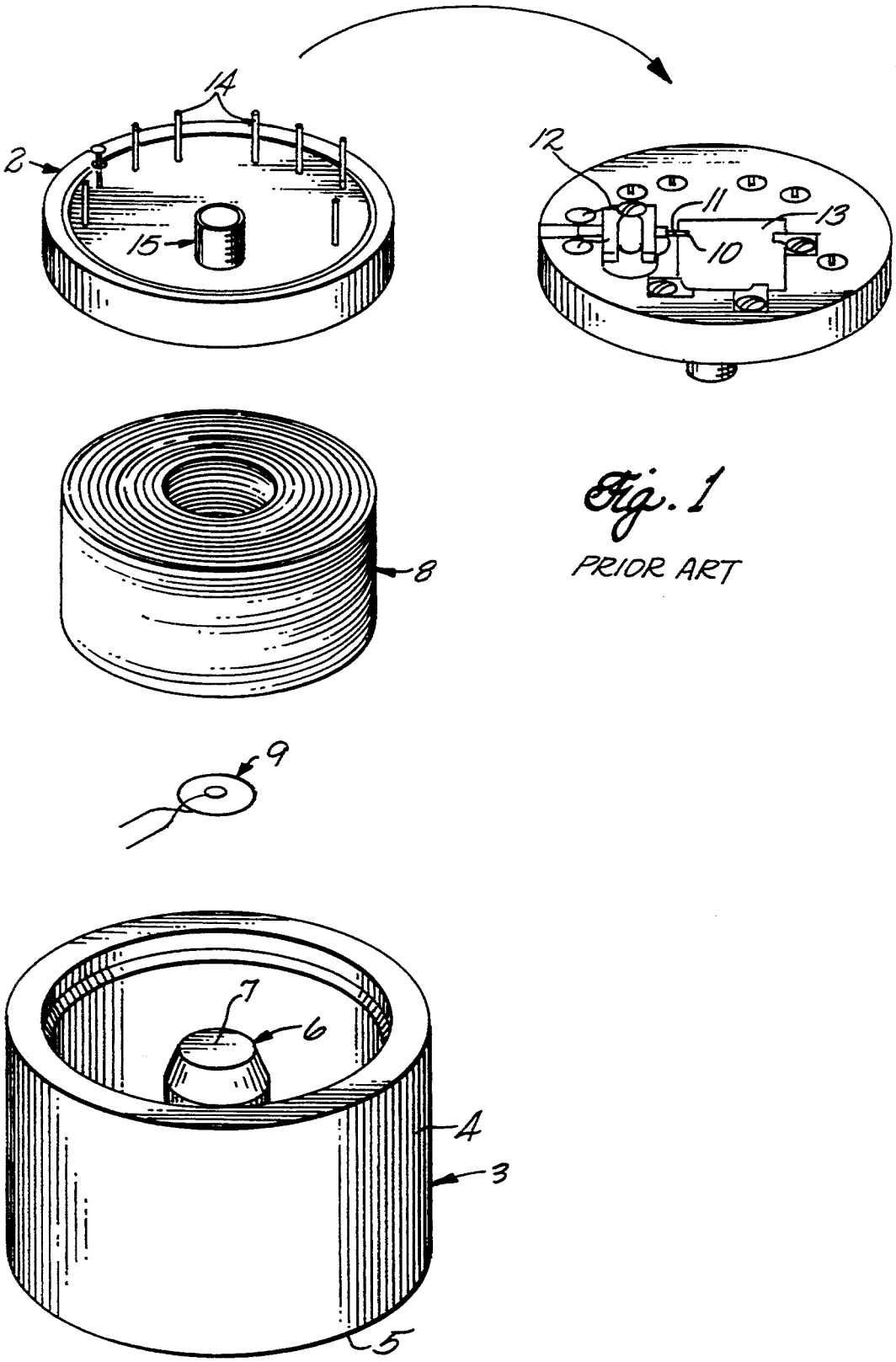
Fig. 1 PRIOR ART
FIG. 1 shows an exploded view of a conventional type YIG-component.

FIG. 1 discloses a conventional YIG-component in the form of a microwave oscillator. In this component, the housing at the same time constitutes the core of an electromagnet. This core has an upper part 2 and a lower part 3, which is an element which has been turned in one piece from a magnetic iron material. The lower part 3 has a cylinder 4, a bottom 5 and a pole pin 6 extending upwards from the bottom 5 in the centre of the cylinder 4. When the component is assembled, an air gap exists between the upper surface 7 of the pole pin 6 and the cap 2. A coil 8, which is a main coil for coarse adjustment of the frequency, is disposed around the pole pin 6. A modulation coil or Fm-coil 9 for fine adjustment is provided in the air gap, the coil being then glue-fastened to the end surface of the pole pin 6. The modulation coil is a sparsely wound coil (usually 25 windings), which is shaped from a thin insulated copper wire. A ferrite crystal in the form of a sphere 10 is positioned in the air gap and disposed on a dielectric rod 11, most often made of a ceramic, for example saphire, and which is mounted on a carrier 12. The modulation coil 9 is positioned as close as possible to the ferrite crystal 10. The carrier 12 is fixed to the cap 2 on its inside.

On the inside of the cap 2, a ceramic circuit board 13 comprising microwave electronics is also attached. Connections 14 for voltage supply and control of incorporated components are provided in the cap 2 as well as a microwave connection 15, this being a signal output.

The prior art component in FIG. 1 operates as follows. A first control current for controlling the main coil 8 and a second control current for controlling the modulation coil 9 are supplied via connections 14. A magnetic flux is then generated by the main coil 8, of which a large part follows the magnetic iron, that is upwards through the pole pin 6, via the air gap to the upper part 2, downwards through the cylinder 4 and the bottom 5 and returns upwards through the pole pin 6. The modulation coil 9 influences the magnetic flux in the air gap between the upper and surface 7 of the pole pin 6 and the cap 2 on which the ferrite crystal 10 is positioned. In the air gap, an homogeneous magnetic field is obtained. The ferrite crystal 10 has the feature that when positioned in a magnetic field (H-field) of a certain magnitude, a resonance frequency which is proportional to the H-field is obtained. The resonance may be controlled within a certain frequency range, for example 2–20 GHz. It follows from this that the modulation coil 9 controls the resonance frequency of the resonance element, that is the ferrite crystal 10, within a limited frequency range (deviation) in the vicinity of the frequency which is determined by remaining elements and factors, including the permanent magnet, the main coil, the air gap and the magnetic structure. The ferrite crystal 10 is connected to an electric oscillator circuit on the circuit board 13. The oscillator circuit generates an electric wave (oscillation) having a frequency which corresponds with the resonance frequency of the ferrite crystal 10. Coarse adjustment of the frequency is made by means of the main coil 8 and fine adjustment is made by means of the modulation coil 9. The generated microwave signal is connected to the signal output 15. This prior art design of the electromagnetic core 1 generates a comparatively great useless flux, that is a magnetic flux which will not pass through the air gap but which will instead flow directly from the pole pin 6 to the cap 2.

When a greater frequency change is to be obtained, the control current to the main coil 8 is firstly changed and in some cases the frequency is fine-adjusted by changing the control current to the modulation coil 9. When changing the current in said coils, eddy currents are induced in the core of the electromagnet which attempt to counteract the change. Said eddy currents appear predominantly in the surface layer of the magnetic material. The decay time of the eddy currents is proportional to the circumference of the magnetic core transverse to the magnetic flux. The prior art design of the magnetic core according to FIG. 1 will give rise to substantially five different decay times or time constants in different parts of the magnetic core 1. This brings with it a comparatively long settling time for the component 10, which, however, may be partly compensated by means of separate control electronics including a compensation network for each time constant, that is up to five different compensation networks. The considerable useless leakage flux contributes to a large inductance in the component 10. The settling time is also delayed by this large inductance. Additionally, the modulation features of the modulation coil are negatively influenced by said eddy currents.

Figure 2:
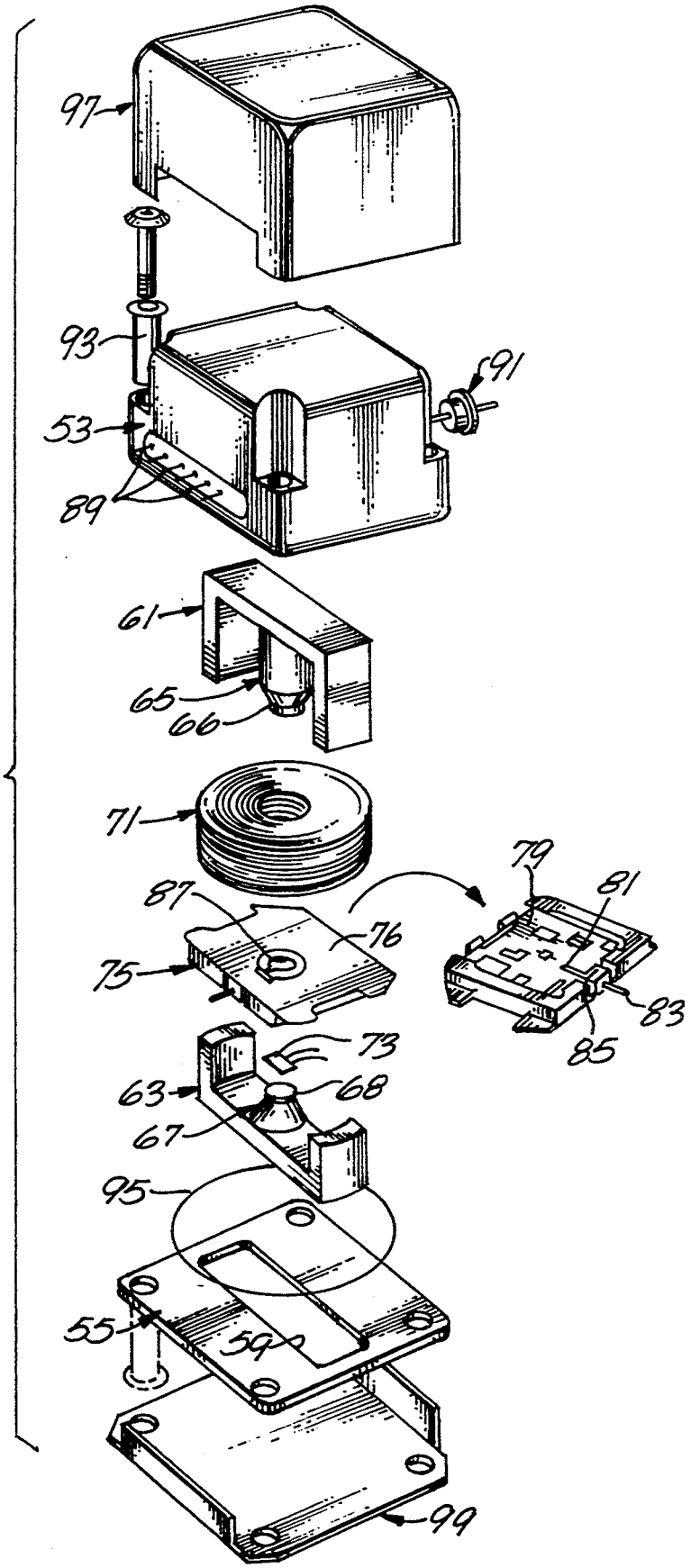
FIG. 2 discloses an exploded view of an embodiment of a YIG-component according to the invention.
Figure 3:
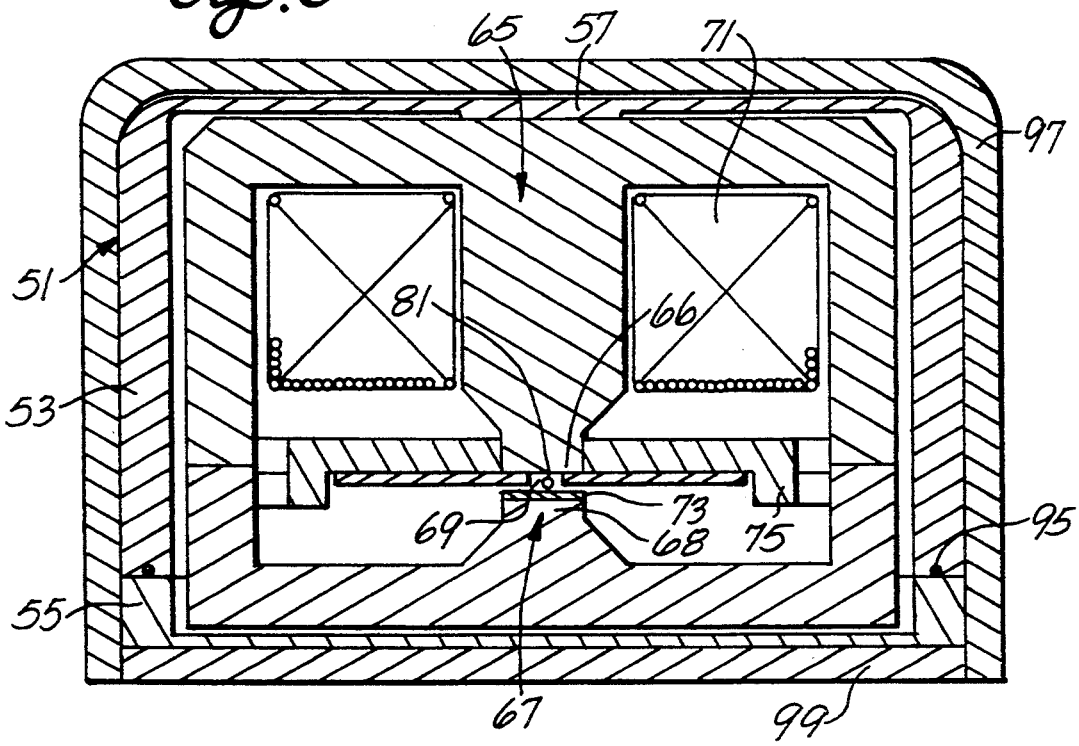
FIG. 3 discloses a second view of the assembled YIG-component as disclosed in FIG. 2.
Figure 4:
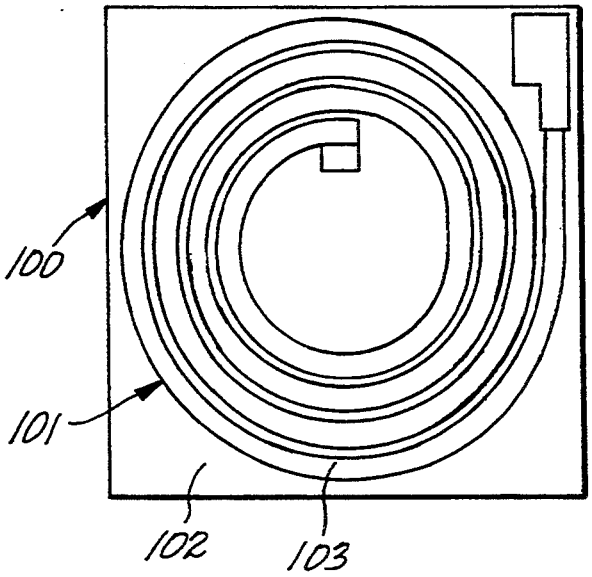
FIG. 4 discloses a plan view of a preferred embodiment of the modulation coil which is comprised in the YIG-component.

FIGS. 2 and 3 disclose an embodiment of a YIG-component according to this invention. This embodiment, which is disclosed in an exploded view in FIG. 2 and a sectional view in FIG. 3, is a microwave oscillator. This YIG-component comprises a housing 51 having a cap 53 and a bottom 55. In the bottom 55, a recess 59 is defined. In the cap 53, a seat 57 is precision-shaped for accommodating a magnetic core 61, 63 this being a part of a magnetic circuit formed as an electromagnet. This new construction principle reduces the sensitivity to mechanical influence because the electromagnet is protected by the housing 51. Said core comprises an upper part 61 arranged in the cap 53 of the housing 51, and a lower part 63, which connects with said upper part 61. The magnetic core 61, 63 is E-shaped in this embodiment and is built up from elements having substantially one and the same circumference around a section transverse to the direction of the magnetic flux through the element. The magnetic core comprises an upper pole pin 65 and a lower pole pin 67, defining an air gap or pole gap 69 (see FIG. 3). The end of each of said pole pins 65, 67 which is directed towards the air gap 69 is tapered into a respective end part 66 and 68. The electromagnet furthermore comprises a main coil 71, surrounding the upper pole pin 65 and fixed to the cap 53, and a modulation coil 73 or Fm-coil, arranged adjacent or in the air gap 69 and being attached to either one of the pole pins 65 and 67. The modulation coil 73, may, for example, be glue-fastened onto the end surface of the lower pole pin 67. As shown in FIG. 4, said modulation coil 73 is preferably made as a printed circuit 100 in the form of a conductive pattern 101 in one or several layers provided on a very thin carrier 12, having preferably a thickness which is $<<0,1$ mm. The printed circuit disclosed in FIG. 4 comprises two identically shaped layers, one of which is arranged on the upper side of the carrier 102 and the other on its underside (not shown). The coil conductor 103, being helically arranged, is initially formed very thin and thereafter, by gold plating, brought to a thickness which is sufficient in order to fulfill the requirements of low resistance. The YIG-component is further provided with a YIG-unit 75, comprising a discshaped ceramic circuit carrier 76, which is arranged adjacent to, and fixed on, a surface of a foundation in the cap 53 of the housing 51. Among other things, a ceramic circuit 79 including microwave electronics and a ferrite crystal 81 are dipsosed on the ceramic circuit carrier 76. Said ferrite crystal 81 is then arranged at one end of a rod 83 being in turn carried by a support 85. The support 85 is connected to the ceramic carrier 76. The microwave circuit 79 is electrically connected to the ferrite crystal 81. A heating element (not shown) keeping the YIG-crystal 81 at a constant temperature via the support 85 is arranged on the support 85. One substantial advantage is that the new construction according to the invention has made it possible to assemble the integral parts of the YIG-unit 75 into a substantially self-supporting unit. A hole 87 is formed in the ceramic circuit carrier 76. When arranging the ceramic circuit carrier 75 in the cap 53, the end part 66 of the upper pole pin 65 projects into the hole 87, which has a slightly larger diameter than the diameter of the end part 66. This provides for centering of the ferrite crystal 81 in the homogeneous magnetic field in the air gap 69. For vertical alignment of the ferrite crystal 81 it is important that the upper part 61 of the magnetic core is machined accurately to a predetermined height and that the distance from the bottom of the seat 57 to the surface of the foundation in the cap 53 is adjusted accurately by machining using the same tools in the same set-up. The precision working of the housing 51, the magnetic core 61 and also the support 85 assure a good alignment of the ferrite crystal 81 in the homogeneous magnetic field and minimizes the need for readjustment.

Current/voltage-connections 89 for feeding supply voltages and control currents etc, as well as a microwave output 91 are arranged in the housing 51. The high frequency output signal is obtained at the microwave output 91. The cap 53 and the bottom 55 of the housing 51 are connected by means of tubular rivets 93. A sealing ring 95 between the cap 53 and the bottom 55 provides for good sealing between the cavity of the housing 51 and the environment. The housing 51 may be enclosed by a casing 97, 99 of magnetic plate, so called $\mu$-metal, providing a magnetic shield for minimal leakage of the magnetic field to the surroundings and elimination of external magnetic disturbances. This shield is much smaller and more effective than the correspondingly arranged shield of the prior art construction because said casing 97, 99 is not in direct contact with the magnetic core 61, 63, an extra non-magnetic gap being obtained between the shield 97, 99 and the magnetic core 61, 63.

The embodiment of a YIG-component according to the invention as disclosed in FIGS. 2 and 3 operates substantially in the same way as the prior art construction. Accordingly, current is supplied via a connection 89 to the main coil 71 for coarse adjustment of the frequency of the output signal from the component. Correspondingly, fine adjustment is obtained by means of the modulation coil 73. The current through the coil 71 generates a magnetic flux substantially following a closed loop through the magnetic core 61, 63, upwards through the lower pole pin 67 and the upper pole pin 65 via the air gap 69, sideways, downwards through side elements, inwards to the centre and again upwards through the lower pole pin 67. A strong, homogeneous magnetic field is then obtained in the air gap 69 in which the ferrite crystal 81 is positioned. The ferrite crystal 81, in combination with the microwave circuit 79, generates a signal of a certain frequency which is directly related to the strength of the H-field. The signal is supplied to the output 91.

Even if the main operation principle are the same, the new structure of the YIG-component nevertheless provides for a number of operating advantages in comparison with prior art components, beyond the great advantages of the construction as such. A substantially smaller useless magnetic flux or leakage flux is obtained by this new magnetic core construction 61, 63 in comparison with the prior art construction. The improved performance of the new construction and the further design of the YIG-component, as discussed above, allows for simplified production of a highly complicated and compact component, which is substantially smaller and has a substantially lower weight than prior art YIG-components.

The choice of the material for the housing 51 may be made reasonably at will, which allows for a choice of an easily workable, low weight material which is nevertheless robust. Preferably aluminium or zinc is used. However, it may be an advantage to use $\mu$-metal, at least partially.

When the currents in the coils 71, 73 are changed in order to obtain a change of the output signal frequency, eddy currents are induced in the magnetic core 61, 63. By dimensioning the parts of the core such that each section through the material transverse to the direction of the flux therein has substantially one and the same circumference, substantially one time constant is obtained, which is explained by the fact that the eddy currents are substantially surface related. This means that it is possible to use only one compensation network in order to obtain a fast settling time. Furthermore, the low leakage flux provides for a low inductance in the main coil 71, also shortening the settling time. A further improvement may be obtained by building the magnetic core from laminates, because this will reduce said eddy currents.

The dimensions of the section of the magnetic core 61, 63 may be further decreased due to the reduced leakage flux. It is thereby possible to obtain even shorter time constants for said eddy currents.

The coil 73 has a lower number of winding turns than conventional type coils, which in combination with the fact that it is formed as a printed circuit 100 provides for small dimensions. The reduced number of winding turns is made possible by the miniaturized construction according to the invention with a very narrow air gap 69, because the number of winding turns is substantially proportional to the length of the air gap, and the new design of the coil 73, which enables positioning of the coil 73 close to the ferrite crystal 81. The conductor of the modulation coil 73 is substantially shorter than the conductor of the modulation coil in the prior art, which provides for a reduction in the the eddy currents in the pole pin. In turn this leads to an enlarged bandwidth (modulation bandwidth) of the modulation coil 73. The modulation bandwidth is defined as the frequency at which the sensitivity of modulation has decreased to 71% (−3 dB) of the sensitivity at 0 Hz.

The combination of the very thin coil, the reduced number of winding turns of the coil, the narrow air gap and the fact that the coil is arranged in close vicinity to the ferrite crystal provides for a YIG-component having modulation features which are significantly improved in relation to prior art YIG-components using conventionally built magnetic structures.

A further great advantage of the new construction is that it allows for an integration of several YIG and other electric functions within the same housing. Accordingly, mixers, filters, power dividers, amplifiers etc., may be integrated to form one module. Accordingly, what formerly required a number of separate components having intermediate conductors may be integrated into one and the same housing 51 in the construction according to the invention. It follows from this that an optional system may be built and enclosed in the housing 51, whereby several cavities having several magnets and/or several ferrite crystals may even be provided therein. Also other electronics for controlling and supervising YIG-components, such as circuits for voltage-to-current transformation ("drivers") of a miniaturized design may be integrated into the same housing 51.

The size of the said new YIG component allows for direct integration into a subsystem unit. By this integration, the control connections are simplified because of reduced requirements for protection against interfering radiation (EMI). This also provides for a system which is substantially non-sensitive to external electric disturbances.

As is evident to the man skilled in the art, the embodiment which has been described above is only one example of an YIG-component according to the invention and changes may be made within the framework of the inventive idea as it is defined in the attached patent claims. For example, the shape of the magnetic core may be varied as long as it fulfills the criteria established for dimensioning with regard to time constants and/or leakage flux, and the same may be shaped in one piece or comprise a number of separate parts. Furthermore, the housing, the ceramic circuit carrier, etc., may clearly be shaped in different ways. Instead of being an electromagnet, the magnetic circuit may comprise a permanent magnet in a magnetic structure or may comprise combinations of electro- and permanent magnets. In components using only one defined frequency, a permanent magnet may be used instead of the electromagnet. The modulation coil may be shaped conventionally from a thin, isolated copper wire.

The sealing of this new YIG component can also be made hermetic using a slightly different mechanical design.

We claim:

1. A YIG component comprising:

a cavity having disposed therein a magnetic circuit for generating an homogeneous magnetic field in an air gap defined by pole pins of the magnetic circuit, and having disposed therein a YIG unit comprising a carrier and at least one ferrite crystal disposed in said air gap, the cavity being formed in a housing for mechanically relieving the magnetic circuit of external influence; wherein said housing has formed integrally therein a seat for supporting the magnetic circuit and for accurate positioning of the magnetic circuit and thereby of the air gap;

said housing has precision shaped therein a base for supporting said carrier with correct positioning of said at least one ferrite crystal in the air gap; and said magnetic circuit comprises an electromagnet having a magnetic core including said pole pins, said magnetic core comprising elements having substantially the same circumference around a section transverse to the direction of magnetic flux therethrough.

2. A YIG component as claimed in claim 1, wherein said housing is divided into a first part and a second part, wherein the first part is made of aluminium, wherein said seat and said base are provided in the first part, said magnetic circuit being thereby attached to the first part via said seat.

3. A YIG component as claimed in claim 1 comprising a modulation coil disposed in the air gap, wherein said modulation coil comprises a printed circuit carrier having a spiral conductive pattern thereon.

4. A YIG component as claimed in claim 1, wherein said YIG unit further comprises a microwave circuit and means for electrically interconnecting the microwave circuit and the ferrite crystal, said carrier supporting the microwave circuit and the ferrite crystal and the means for electrically interconnecting the microwave circuit and the ferrite crystal.

* * * * *